United States Patent [19]

Canup

[11] 4,414,954

[45] Nov. 15, 1983

[54] INTERNAL COMBUSTION ENGINE IGNITION SYSTEM WITH IMPROVEMENT

[75] Inventor: Robert E. Canup, Poughkeepsie, N.Y.

[73] Assignee: Texaco Inc., White Plains, N.Y.

[21] Appl. No.: 382,545

[22] Filed: May 27, 1982

[51] Int. Cl.[3] ..... F02P 1/00

[52] U.S. Cl. ..... 123/606; 123/637

[58] Field of Search ..... 123/606, 609, 610, 611, 123/620, 637, 636

[56] References Cited

U.S. PATENT DOCUMENTS

| | | | |
|---|---|---|---|
| 3,792,695 | 2/1974 | Canup | 123/606 |
| 3,926,165 | 12/1975 | Merrick | 123/637 |
| 3,926,557 | 12/1975 | Callies | 123/637 |
| 3,976,043 | 8/1976 | Canup | 123/609 |
| 4,003,354 | 1/1977 | Canup | 123/610 |
| 4,091,787 | 5/1978 | Frank | 123/637 |
| 4,183,340 | 1/1980 | Gilbert | 123/609 |

*Primary Examiner*—Ronald B. Cox

*Attorney, Agent, or Firm*—Carl G. Ries; Robert A. Kulason; Henry C. Dearborn

[57] ABSTRACT

In the combination of an internal combustion engine which has an electronic ignition system that develops a continuous high-voltage AC type spark signal, there is an improvement which provides for controlling the duration of the spark signals. Such duration control acts to vary the crank angle degrees that are encompassed by the spark duration, which variation is in accordance with an engine parameter. The parameter may be engine load, and the variation control saves spark energy consumed while extending the life of the spark plugs.

4 Claims, 1 Drawing Figure

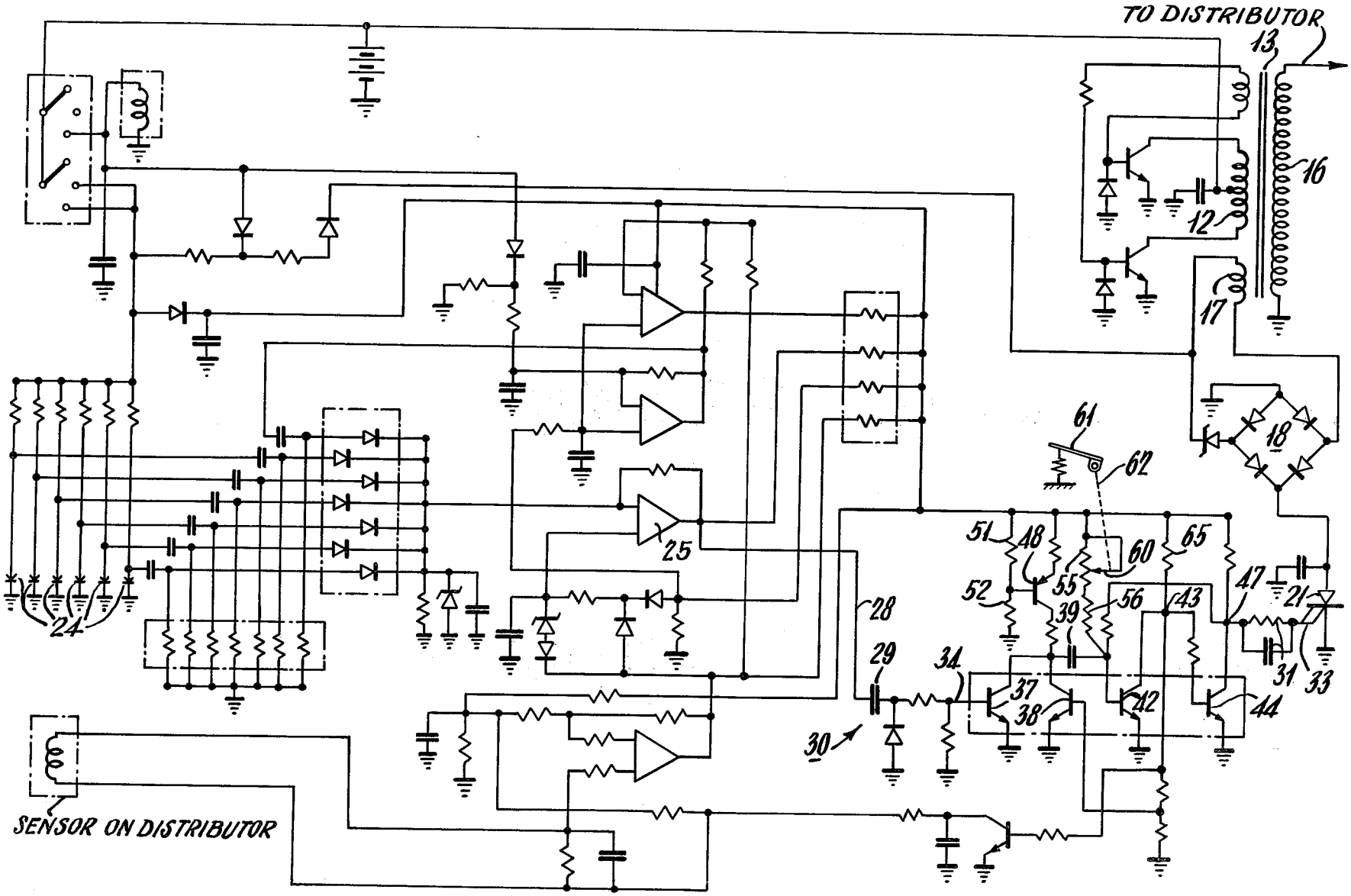
TO DISTRIBUTOR
SENSOR ON DISTRIBUTOR

INTERNAL COMBUSTION ENGINE IGNITION SYSTEM WITH IMPROVEMENT

BACKGROUND OF THE INVENTION

1. Field of the Invention

This invention concerns ignition systems for internal combustion engines in general. More specifically, it relates to a system that is applicable to an ignition circuit for an internal combustion engine wherein the ignition circuit is a continuous AC type spark signal generating arrangement.

2. DESCRIPTION OF THE PRIOR ART

Much development has taken place in ignition systems for use with internal combustion engines. Included in such prior art, are the following U.S. patents, i.e. U.S. Pat. No. 3,926,557 issued Dec. 16, 1975; U.S. Pat. No. 4,041,912 issued Aug. 16, 1977; U.S. Pat. No. 4,066,054 issued Jan. 3, 1978; U.S. Pat. No. 4,082,075 issued Apr. 4, 1978; and U.S. Pat. No. 4,112,890 issued Sept. 12, 1978. However, while those patents appear to suggest controlling ignition spark signals for a variety of reasons relating to engine conditions, they do not disclose an ignition system which employs a continuous high-voltage AC spark signal the duration of which is controlled for spanning a predetermined degree of crank shaft revolution.

Thus, it is an object of this invention to provide a control system for use with a continuous AC high-voltage type spark signal that varies the duration relative to the degree of crank shaft rotation and in dependence upon a motor parameter, in order to make efficient use of the spark energy being developed.

Another object of the invention, is to provide a control for an ignition system that employs high-voltage continuous AC type spark signal energy in such a manner that the duration of the spark signal may be varied in accordance with the fuel control arm, so that the spark plug life may be lengthened without reducing the efficient operation of the internal combustion engine to which the spark system is applied.

SUMMARY OF THE INVENTION

Briefly, the invention relates to and is in combination an internal combustion engine having a crank shaft and an electronic ignition circuit. The said ignition circuit has a continuous high-voltage AC type spark signal of variable duration, and the said circuit includes electronic switch means for starting and stopping the said spark signal. The invention includes control means for said electronic switch means, which control means comprises means for actuating said switch means to start said spark signals in timed relation to said crank shaft. And, it includes means for actuating said switch means to stop said spark signals after a variable time interval which is inversely related to the speed of said engine in order to provide a duration of said spark signals having a predetermined number of degrees of crank shaft rotation. The control means also comprises means for controlling said variable time interval to adjust said predetermined number of degrees of crank shaft rotation in accordance with a parameter of said engine operation.

Again briefly, the invention is in combination an internal combustion engine having a crank shaft and a fuel control arm and an electronic ignition circuit. The said ignition circuit has a continuous high-voltage AC type spark signal of variable duration. The said circuit includes electronic switch means for starting and stopping said spark signal. The invention includes control means for said electronic switch means, which control means comprises means for actuating said switch means to start said spark signals in timed relation to said crank shaft. And, the control means comprises means for actuating said switch means to stop said spark signals after a variable time interval which is inversely related to the speed of said engine so as to provide a duration of said spark signals having a predetermined number of degrees of crank shaft rotation. The control means also comprises means for controlling said variable time interval which latter means comprises a variable resistor, and a coupling to said fuel control arm for varying said variable resistor. It also comprises a fixed resistor in series with said variable resistor to determine a minimum number of degrees of crank shaft rotation.

BRIEF DESCRIPTION OF THE DRAWING

The foregoing and other objects and benefits of the invention will be more fully set forth below in connection with the best mode contemplated by the inventor of carrying out the invention, and in connection with which there are illustrations provided in the drawings, wherein:

The FIGURE of drawings illustrates a schematic circuit diagram showing the elements of an ignition system in accordance with the invention.

DESCRIPTION OF THE PREFERRED EMBODIMENT

The invention is applicable to an ignition system for an internal combustion engine where the ignition system is a type that develops a continuous high-voltage AC type spark signal. That type of spark ignition system has been described in a number of my earlier patents, e.g., U.S. Pat. No. 3,820,520 issued June 28, 1974 and U.S. Pat. No. 3,961,613 issued June 8, 1976. These ignition systems have electronic switch means which act to control the starting and stopping of the spark signal. That spark signal develops a continuous high-voltage AC type spark that may be started in timed relation to the crank shaft of the internal combustion engine so as to provide spark at the desired time with relation to each cylinder.

With reference to the FIGURE of drawings, it will be observed that there is an oscillator circuit 11 that includes a center tapped primary winding 12 on a transformer 13. The transformer 13 develops high-voltage AC type spark signals in a secondary winding 16 that has its output connected to the distributor of the engine, as indicated by the caption.

As indicated above, the operation of the type ignition system of concern is described in the aforementioned U.S. patents of mine. The control of the starting and stopping of the ignition signal is carried out by having a control winding 17 with a diode bridge 18 and a controlled rectifier 21 in circuit therewith. The oscillator 11 is started and stopped by electromagnetic conditions which are determined by the control winding 17. There is a DC bias current which flows in the control winding 17 during the time when the oscillator 11 is stopped. And, at the same time there is an AC short circuit across the winding 17 which loads the oscillator and holds it non-oscillating. That AC short circuit is controlled by a controlled rectifier 21. And, when it is cut off, i.e. made non-conducting, the decaying magnetic field of control winding 17 ensures positive, instantaneous starting of the oscillator 11. At the end of a desired AC spark signal interval, the rectifier 21 is made conducting once more and the indicated load is applied to the oscillator 11 by the AC short circuit across the winding 17. The short circuit acts via the diode bridge 18 and the rectifier 21 as well as a Zener diode 27, to hold the short circuit on the winding 17 so long as the controlled rectifier is conducting. Thus, the controlled rectifier 21 acts as an electronic switch and it is controlled in timed relation to the engine crank shaft by having breaker points (not shown). Or, in the illustrated system, the engine timed control is done by making use of fuel injectors 24 in electrical circuit arrangements so as to develop a control signal at each cylinder as the fuel injection takes place. In the illustrated system there are a plurality of the fuel injector valves 24 schematically indicated. And, the fuel injection signals are passed on through the circuit arrangements shown, to a comparator 25.

This development of ignition control signals from the injector valves 24 is carried out in a manner that is not directly pertinent to this invention, but that has been described in greater detail in a copending application of mine Ser. No. 373,322 filed Apr. 30, 1982. Output signals from the comparator 25 are carried over a circuit connection 28, and via a capacitor 29 to an input of a network 30. The network 30 has its output applied over a combined resistor and capacitor 31 to a control element 33 of the controlled rectifier 21.

By applying a known circuit arrangement that is employed in the network 30, the ignition control pulses which are received via the circuit connection 28 and via capacitor 29, will develop an output signal at control element 33 which cuts off the controlled rectifier 21 for a predetermined time interval. During that time interval, the spark signals will be produced as described above. At the end of such time interval the spark signals will be stopped when the output signal at control element 33 goes back up so as to make the rectifier 21 conductive once more. And, thus the time interval during which the controlled rectifier 21 is cut off (or nonconducting) is controlled by the network 30.

In the network 30 there is an input connection 34 which receives pulses through the capacitor 29. The input connection 34 goes to the base electrode of and so controlls a transistor 37. The transistor 37 is connected in a parallel circuit arrangement with another transistor 38. And, capacitor 39 passes signals on to another transistor 42 which transmits its output via a point 43 (in the network 30) to another transistor 44. Transistor 44 determines the signal conditions at the control element 33 of the rectifier 21, via a circuit point 47.

The network 30 also includes a transistor 48 that is connected as an element of a constant current generator circuit which is connected to one side of the capacitor 39 so as to control the charging current thereof. This means that the charging current on the lefthand side of the capacitor 39 will increase linearly with time, and the maximum voltage will be set by the ratio of a pair of resistors 51 and 52.

The other side of the capacitor 39 has a variable resistor 55 and a fixed resistor 56 connected in series thereto. Consequently, these series resistors are also connected to the input of the transistor 42. Therefore, they control the time duration of the nonconducting state of transistor 42. And, it may be noted that the circuit arrangements are such as to make the transistor 38 conduct whenever the transistor 42 is nonconducting. The signal to control the ignition spark signals goes on via the point 43 and the transistor 44, to be applied to the control element 33 of the controlled rectifier 21.

The indicated circuits of the network 30 produce a timing circuit such that an inverse relationship is created between the speed of the engine (i.e. the frequency of the pulses received from the fuel injection signals that are passed on via the comparator 25) and the time duration of the output or control signal that is applied to the control element 33 of the controlled rectifier or electronic switch 21. Consequently, by having the proper circuit constants, i.e. the values of resistors 55 and 56, the time duration of the control signal output at control element 33 may be determined so as to have it encompass a constant angle (degrees) of rotation of the crank shaft of the engine irrespective of speed. In other words, the faster the input pulses the shorter the time duration at the control signal output. And, by proper choice of circuit constants, the crank angle encompassed by the time interval produced, will remain constant since at slower speeds the time interval is longer while it is shorter at higher speeds.

By connecting a slider element 60 which is on the variable resistor 55, to a fuel control arm 61 (indicated by a dashed line 62), the predetermined number of degrees of crank angle which the network 30 controls, may be varied. This means that the crank angle degrees during which spark signals are applied, may be adjusted in relation to the load on the engine. This is because the fuel control arm 61 determines the quanity of fuel being injected in a diesel type fuel injection system, and it has been found that at heavy or full load the spark signals should be continued for a considerably greater crank angle degree interval compared to the crank angle degrees required at light loads.

OPERATION

The operation of the inverse timing circuit or network 30 which was described above, may be explained as follows. First, in connection with the controlling of the spark signal duration merely with regard to the speed of the engine. As indicated above, this inverse relationship is set by the circuit constants so that it will produce a duration that encompasses a predetermined crank angle degree of rotation for the continuing spark signals as they are developed.

The action in the network 30 may be described beginning with no spark signal conditions, i.e. when the oscillator 11 of the ignition spark signal circuit is not oscillating (no AC spark is being developed). Referring to the input to network 30, starting at transistor 37, the transistors in the network 30 will have the following states. The first transistor 37 will be off, since no ignition control pulse will have been received via the capacitor 29. Consequently, the base electrode of transistor 37 will be at a low potential. A second transistor 42 will be conducting and its base voltage is clamped at about 0.7 volts. A third transistor 44 will be off i.e. nonconducting and consequently, the controlled rectifier 21 will be conducting and therefore the oscillator 11 and the spark signal generating system (via transformer 13) will be off, so that no spark signal is being generated.

When a pulse to control the spark signals is received over the circuit connection 28 and via the capacitor 29, the first transistor 37 is turned on for an instant and then returned off again, as the control pulse is received at its base electrode. When transistor 37 is turned on, it turns off transistor 42 which in turn turns on transistor 38 and these two transistors remain off and on respectively together. In other words, so long as transistor 42 is nonconducting the transistor 38 is turned on and at the same time the transistor 42, being off, turns the transistor 44 on which in turn acts to turn off the controlled rectifier 21. Consequently, those are the conditions at the commencement of a spark signal duration.

The inverse timing control of the network 30 determines how long the controlled rectifier 21 will be nonconducting. And, it involves the capacitor 39 and the transistor 48. Transistor 48 is a PNP type transistor that is connected to act as a constant current generator. The action of the timing circuit may be described as follows. At the instant when the transistor 42 is turned off, the righthand side of the capacitor 39 charges toward battery voltage through the resistors 56 and 55 until a voltage of 0.7 volts is reached. As soon as that voltage level is reached the transistor 42 turns on again and its collector voltage goes down due to current flow through a resistor 65. Consequently, the subsequent transistor 44 is turned off again at the end of a spark signal interval and also the controlled rectifier 21 is turned on to stop the spark signal.

The turning back on of the transistor 42 turns transistor 38 off and this permits the lefthand side of the capacitor 39 to charge via the constant current generator which includes the transistor 48. Since this is a constant current flow the charge on this lefthand side of the capacitor 39 will increase linearly with time, and the maximum voltage is set by the ratio of the resistors 51 and 52. The rate of charge is determined by the resistance of the combined variable resistor 55 and resistor 56.

The amplitude of a negative pulse that is created on the righthand side of the capacitor 39 when it discharges through the transistor 37, is determined by the magnitude of the voltage that is impressed on the lefthand side of the capacitor 39. Consequently, if the lefthand side voltage is large the negative voltage on the righthand side will also be large. Then, the time required for the transistor 42 to be turned back on (as indicated above) will be longer than if the pulse were lower in amplitude. Also, the charge on the lefthand side of capacitor 39 will be large if there is a long time interval between pulses received from the control signals via the capacitor 29. Thus, when the engine is turning over rapidly (at a high rate of revolutions) the intervals between pulses received through the capacitor 29 will be short, and the charge on the lefthand side of the capacitor 39 will be small. Therefore, it will be understood that by proper determination of the circuit constants involved, the timing may be set so as to be directly in inverse proportion as the speed of the engine, i.e. the rotations of the crank shaft. Consequently, the continuous AC spark signal duration may be determined so as to maintain a predetermined constant degree of crank shaft rotation during which the spark signal exists throughout the speed range.

By adding the fuel control arm connection 62 so as to adjust the variable resistor 55, the crank angle duration of the spark signals may be varied in accordance with the load, as determined by the fuel control arm 61. This produces the beneficial effect of producing adequate duration spark signals for heavy loads while reducing the duration of the spark signals at light loads. The result saves on the power consumed by the spark signal generating system, as well as reducing the spark plug wear, i.e. errosion of the electrodes and increase of the gap.

While a particular embodiment of the invention has been described above in considerable detail in accordance with the applicable statutes, this is not to be taken as in any way limiting the invention but merely as being descriptive thereof.

I claim:

1. In combination, an internal combustion engine having a crank shaft and a fuel control arm and an electronic ignition circuit, said ignition circuit having a transformer with center tapped primary winding forming an oscillator to develop a continuous high-voltage AC type spark signal of variable duration, said circuit including a control winding on said transformer for starting and stopping said oscillator and electronic switch means comprising a controlled rectifier for starting and stopping said spark signal, and control means for said controlled rectifier, comprising a transistor network having an input for receiving ignition control pulses in timed relation to said crank shaft and an output for controlling said controlled rectifier, said transistor network comprising means for cutting off said controlled rectifier to start said spark signals in timed relation to said crank shaft, said transistor network also comprising means for actuating said controlled rectifier to conduct in order to stop said spark signals after a variable time interval inversely related to the speed of said engine, said transistor network having circuit constants to provide a duration of said spark signals having a predetermined number of degrees of crank shaft rotation, and said transistor network also comprising means for varying one of said circuit constants to control said variable time interval, comprising a variable resistor, a coupling to said fuel control arm for varying said variable resistor, and a fixed resistor in series with said variable resistor to determine a minimum number of degrees of crank shaft rotation.

2. The invention according to claim 1, wherein said ignition control pulses are developed from injector valves.

3. The invention according to claim 2, wherein said transistor network input comprises a pair of transistors connected in parallel circuit arrangement, and said transistor network also comprises a third transistor connected as an element of a constant current generator circuit.

4. The invention according to claim 3, wherein said transistor network also comprises a capacitor having one side connected to said constant current generator circuit and the other side connected to said circuit constants.

* * * * *